United States Patent [19]

Svaty

[11] Patent Number: 4,623,006

[45] Date of Patent: Nov. 18, 1986

[54] METHOD OF AN APPARATUS FOR CONTROLLING AND MEASURING WEFT THREADS

[75] Inventor: Vladimir Svaty, Liberec, Czechoslovakia

[73] Assignee: Elitex, koncern textilniho strojirenstvi, Liberec, Czechoslovakia

[21] Appl. No.: 628,427

[22] Filed: Jul. 9, 1984

Related U.S. Application Data

[63] Continuation-in-part of Ser. No. 321,275, Nov. 13, 1981, abandoned.

[30] Foreign Application Priority Data

Nov. 17, 1980 [CS] Czechoslovakia ..... 7758-80

[51] Int. Cl.[4] ..... D03D 47/36

[52] U.S. Cl. ..... 139/452

[58] Field of Search ..... 139/435, 450, 452

[56] References Cited

U.S. PATENT DOCUMENTS

| | | | |
|---|---|---|---|
| 3,393,709 | 7/1968 | Rohn | 139/452 |
| 3,411,547 | 11/1968 | Bucher | 139/452 |
| 3,938,561 | 2/1976 | Scheffel | 139/452 |
| 4,342,340 | 8/1982 | Key et al. | 139/452 |
| 4,403,634 | 9/1983 | Jankovsky et al. | 139/452 |

*Primary Examiner*—Henry S. Jaudon

[57] ABSTRACT

A method of controlling weft threads for shuttleless insertion into the shed of a loom, and a rotary measuring tool for performing said method. The present invention aims at improving the weaving conditions relative to the methods hitherto known in accordance with the invention the front end of the weft thread is alternately given a rotary motion in both the same and the opposite directions relative to the direction of winding of the weft thread in dependence upon the weaving process, whereby the front end of the weft thread is periodically wound and released. The rotating measuring tool for performing the method according to the present invention has a rotatably mounted delivery guide attached to a reel, the said delivery guide being kinematically connected with a control cam driven in synchronism with the loom.

6 Claims, 3 Drawing Figures

METHOD OF AN APPARATUS FOR CONTROLLING AND MEASURING WEFT THREADS

This application is a continuation-in-part of application Ser. No. 321,275, filed Nov. 13, 1981, now abandoned.

The present invention relates to a method of and apparatus for controlling and measuring weft threads for shuttleless looms, the weft threads being wound into a helical form during such operation.

Various methods of measuring weft threads for shuttleless looms are known. In these machines, measuring is performed for the purpose of preparing a weft thread supply for picking, which in most cases is performed by means of jets of air or water, i.e. by means which do not grip; the weft thread, but which entrain it by means of frictional forces.

For measuring, measuring tools are used, e.g. in the form of a shaft into which there are deposited weft thread supplies in the form of loops by the action of air. There are also known rotary measuring tools, by which the weft thread supply is prepared continuously, and in which the weft thread is deposited in helical form.

Hitherto, no special requirements have been laid on weft thread measuring tools. The only requirement was that the weft thread supply should be maintained of constant length, so that it would be possible to withdraw it from the supply with small resistance during the picking operation. However, it has been recently found that the manner of controlling the weft thread upon measuring and possibly checking of it has a considerable effect on the passage of the weft thread through the shed of the loom and the following actions. It has been found that an ideal measuring tool should insure:

(a) a single continuous weft thread withdrawal from the supply, (b) a control as precise as possible of the weft thread starting at the beginning of the pick, (c) weft thread feeding during picking at a constant speed, (d) the braking of the weft thread at the end of the pick, (e) releasing the inserted weft thread before separating, (f) withdrawing the excess length of the weft thread upon picking, and (g) a simple adjustment of the length of weft thread to be measured.

The present invention has among its objects the provision of a method of controlling weft thread during measuring which fulfills the above conditions to a maximum extent, and which is easily applicable to a rotary measuring tool without complicating it excessively from both the manufacturing and design aspects.

In accordance with the present invention such aim is achieved by the method of controlling weft thread wound in the form of a rotating helix upon measuring it for insertion in the sheds of shuttleless looms in accordance with the method of the invention the front end of the weft thread is periodically given a rotary motion in synchronism with the progress of the weaving process in both the same direction as the direction of winding of the weft thread and in the direction opposite thereto, the front end of the weft thread thus being periodically wound and released.

The rotary measuring tool of the invention, which performs the above method, has a pivotally mounted delivery guide attached to the reel upon which the weft thread is wound, said guide being drivingly connected with a control cam driven in synchronism with the main shaft of the loom.

It is advantageous to make the reel and the delivery guide mutually radially adjustable, for the purpose of adjusting the length of the measured weft thread within a relatively broad range and with sufficient accuracy.

From the viewpoint of an embodiment of simple design, it is advantageous to mount the delivery guide on a lever which is mounted for radial adjustment on a shaft which is mounted coaxially of the axis of rotation of the reel.

It is also advantageous from the viewpoint of simple design and easy adjustment, to provide on the shaft on which the delivery guide is mounted a gearing engaging a gear segment mounted at the end of a two-arm lever, the second arm of which is provided with a cam following roll cooperating with the control cam.

Further advantages and features of the present invention will be more readily apparent upon consideration of the accompanying drawings, in which.

Figure 1:
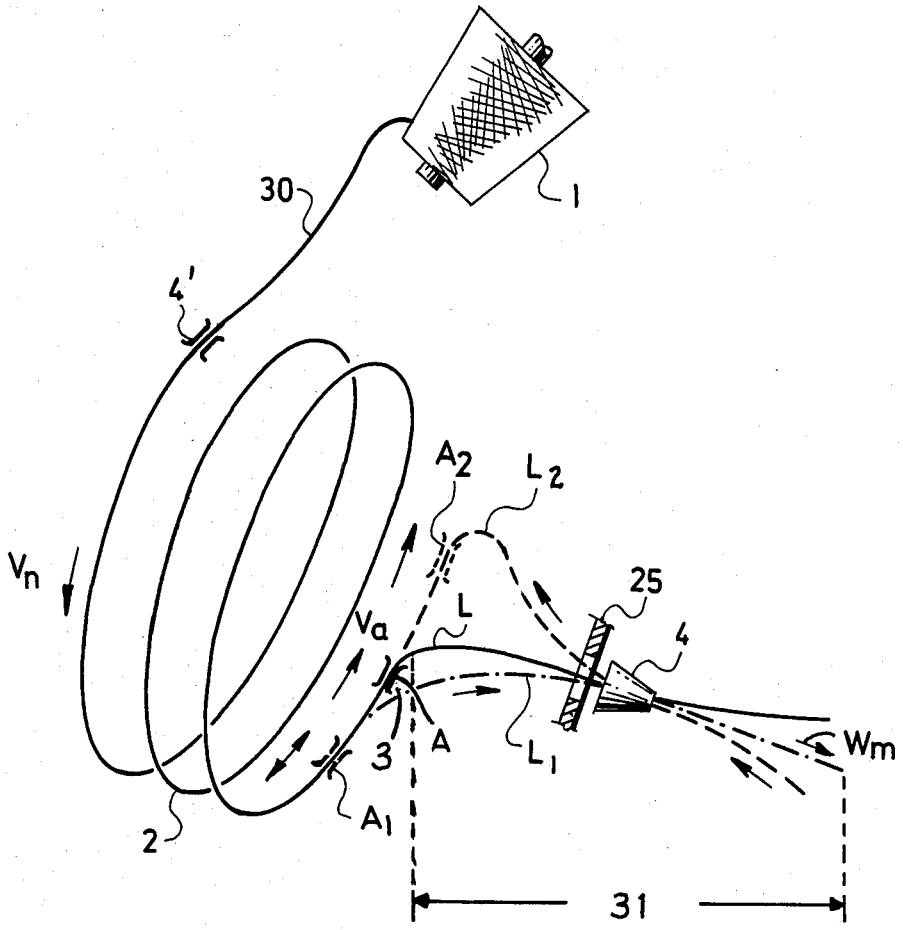
FIG. 1 is a diagram in perspective illustrating the method of controlling weft threads while they are being measured.

Turning first to FIG. 1, upon the measuring of the weft thread, the thread 30 is withdrawn from a cross-wound bobbin 1, passes through a guide 4' and is continuously wound in the form of a rotating helix 2, from which the front or leading end 31 of the weft thread 30 travels through a guide 25 toward the weft inserting means, which is shown in the present case as a jet nozzle 4. Simultaneously, the front end 31 of weft 30 is rotated about the axis of the helical formation 2, e.g. by a guide 3. The velocity at which the helical formation 2 rotates about its axis, and thus also the velocity of winding the weft thread 30 into the helix, is constant, and is designated $V_n$. As will more fully appear hereinbelow, the velocity $V_a$ at which the guide 3 and the front end 31 of weft thread 30 move, is variable the velocity can be higher, constant, lower, or the rotation can be in the opposite direction. The guide 3 also rotates alternately in the direction opposite the direction of rotation of the helical formation 2. The length of the front end 31 of weft thread 30 upstream of nozzle 4 depends upon the relative velocity and the relative directions of movement of guide 3 and of the helical formation 2. When guide 3 moves at a velocity $V_a$, which equals the velocity of rotation of helical formation 2 ($V_a=V_n$), the length ($L_1$) of the front end 31 of the weft remains constant. This condition is represented in FIG. 1 by the position of guide 3 in which it is designated by reference symbol A. At a lower velocity $V_a$ of guide 3 relative to $V_n$, i.e. the velocity at which helical formation 2 rotates, or at which it moves oppositely thereto, the length (L) of the front end 31 of the weft is increased by withdrawing weft thread 30 from the rotating helical formation 2. However, when guide 3 moves at a velocity $V_a$ higher than velocity $v_n$ of the rating helical formation 2, then the length (L) of the front end 31 of the weft is shortened and simultaneously wound to form the helical formation 2. Thus, three different weft thread lengths upstream of the nozzle 4, that is L, $L_1$ and $L_2$, correspond respectively to the three positions A, $A_1$. $A_2$, of guide 3.

Stated in another way, length L represents the condition in which $v_a = v_n$ (the length of the portion 31 of the weft does not change). The length $L_1$ represents the condition $v_a < v_n$ (the front portion 31 of the weft is wound back by means guide 3 to form the helix 2). The length $L_2$ represents the condition in which $v_a < v_n$ or the guide 3 moves in the opposite direction (in this case the thread is unwound from the helix 2 by means of guide 3 and is simultaneously drawn off by means of jet nozzle 4, so that the length $L_2$ increases). The stream of working medium is shown in FIG. 1 by fine or hair lines, and the direction of movement of the thread or various values of $v_a$ as indicated by an arrow.

The speed of rotation of guide 3 and therewith the front end 31 of weft thread 30 and their direction of rotation are changed during each revolution of the measuring device in synchronism with the rotation of the main shaft of the loom, the fulfillment of the prevailing majority of the requirements a–g above set forth for the measurement of the weft is accomplished. Thus, in pneumatic looms in which rotary weft measuring devices are used, which for example deposit the measured weft thread 30 in four helical thread turns, i.e. said measuring tools rotating four times faster than the main shaft of the loom, the correct weft thread control during measuring of the weft is secured in such manner that guide 3 moves during three revolutions at a velocity equal to the velocity of winding of the weft into the helical formation. During the fourth revolution of the rotary measuring device, the guide 3 is rotated three times in the direction opposite to the previous direction of rotation of the measuring device. Thus, four turns of weft thread 30 are unwound from the helical formation 2 during the simultaneous insertion of the weft thread 30 into the shed of the loom by nozzle 4. By precisely controlling the motion of the guide 3, it is possible to secure both the starting and the braking of the weft thread 30 and the further activities described above.

In the embodiment described above, the reel describes 4 revolutions and the guide describes 3 revolutions forward and 3 revolutions backward. It is to be understood that the number of revolutions of the reel is capable of variation. In the measurement of another length of the weft thread, the reel can make e.g. 8 revolutions during 1 revolution of the loom. The guide 3 must then execute a proportional number of revolutions forward and backward; it is obvious that this number need not be a multiple, that is, an integral number.

It will be apparent from the above that in FIG. 1 length L indicates the condition wherein $v_a = v_n$ (the length does not change), the length L1 indicates the condition wherein $v_1 > v_n$ (the front portion 31 is wound back by means of guide 3 to form the helix 2), and the length $L_2$ indicates the condition wherein $v_a < v_n$, that is the guide 3 moves in the opposite direction (in this case the thread is unwound from the helix 2 by means of guide 3 and is simultaneously drawn off by means of jet nozzle 4, so that the length $L_2$ increases). The stream of working medium is indicated by hairlines wm, and the direction of movement of the thread for various velocities $v_a$ is indicated by arrows.

Figure 3:
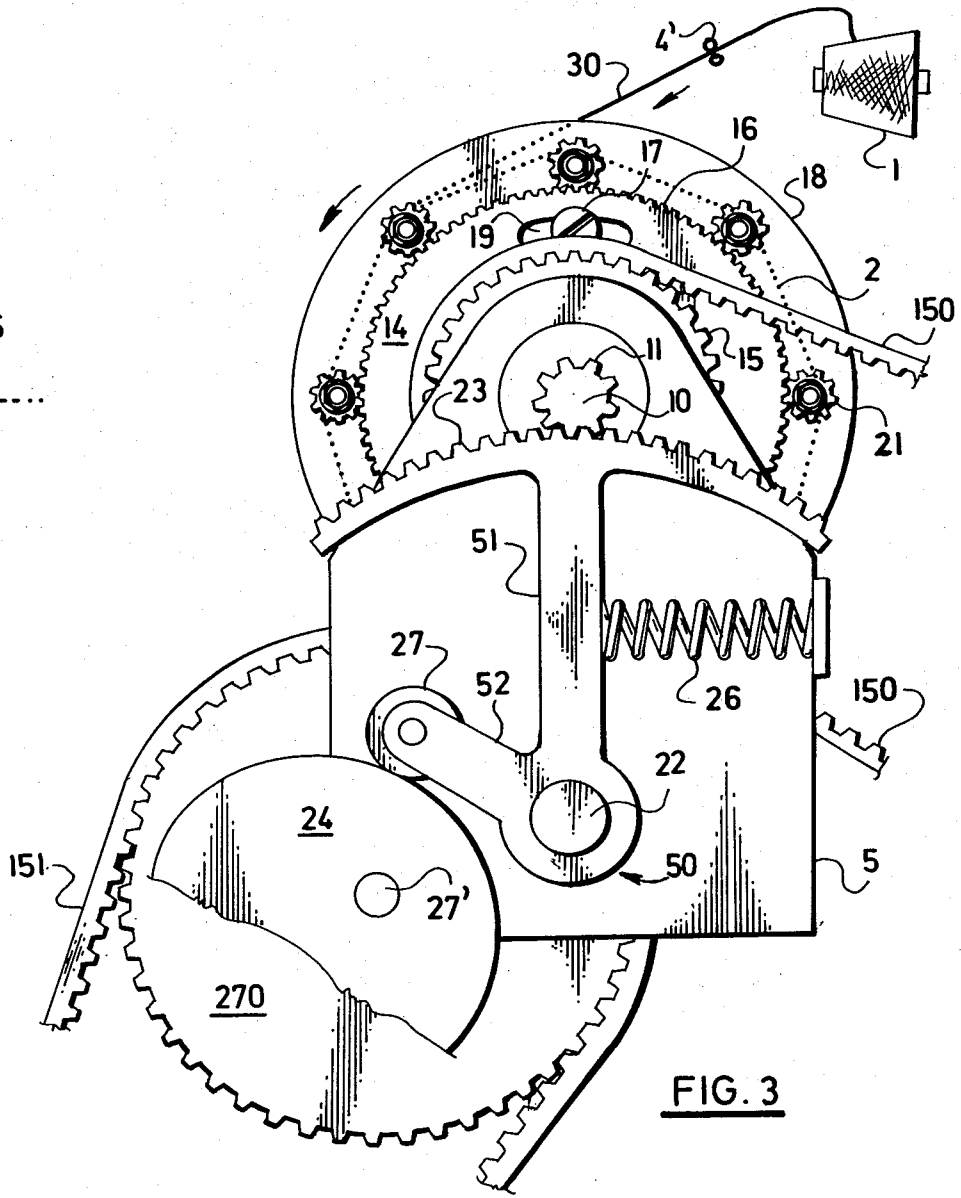
FIG. 2 is a view in vertical axial section through the rotary weft measuring device of the invention and FIG. 3 is a view in front elevation of the rotary measuring tool, the view being taken from the left of FIG. 2 looking toward the right.
Figure 2:
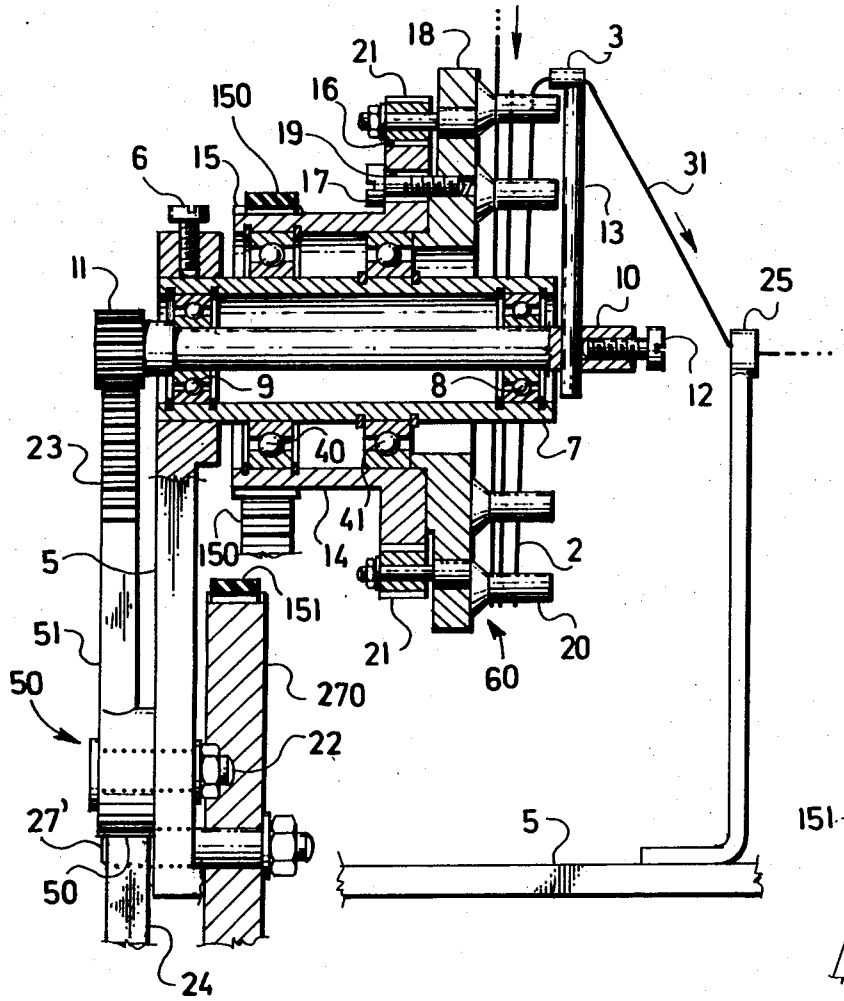

Turning now to FIGS. 2 and 3, the rotary measuring device or tool for performing the method described above includes a tube 7 which is fixedly mounted upon a stationary frame 5 by means of screws of which one is shown at 6. Aligned bearings 8 and 9 are mounted inside tube 7 at the opposite ends thereof for the rotatable mounting of a shaft 10 coaxially of the tube 7. Shaft 10 has a pinion 11 fixedly secured to its left-hand end, as shown in FIG. 2. At the right-hand end of shaft 10, beyond such end of the tube 7, there is adjustably mounted a radial arm 13, the root of the arm extending through a slot in shaft 10 and being secured thereto in adjusted position by a set screw 12. A weft thread delivery guide 3 is mounted on the radially outer end of the arm 13.

Telescoped over the tube 7 and supported thereupon coaxially thereof by bearings 40 and 41 is a tubular member 14. Member 14 has a timing driving belt sprocket 15 receiving a timing belt 150 formed upon its left-hand end (FIG. 2) and a larger diameter gear 16 formed upon its right-hand end. A disc 18 is secured to the right-hand end of member 14 coaxial thereof, as shown, disc 18 being connected for angular adjustment relative to member 14 by a screw 17 which is screwed into the member 18 and passes through an arcuate slot 19 in the gear 16. On the disc 18 there is mounted a reel made up of a plurality of radially adjustable pins 20 about which the weft thread 30 is wound to form the helical weft thread formation 2. As is shown in FIG. 2, the pins 20 are mounted on the axially outer ends of eccentric cranks, 60 to the axially inner end of each eccentric cranks there being affixed a pinion 21. In order to adjust the effective diameter of the reel, the screw 17 is loosened and the disc 18 is rotated relative to the member 14 in the required direction. Thereafter the screw 17 is tightened.

On fixed frame 5 there is a stub shaft 22 on which there is swingably mounted a two-arm lever 50, one arm 51 of which has a gear segment 23 affixed to its upper, radially outer end, whereas the other arm 52 has a cam following roller 27 rotatably mounted upon its outer end. The roller 27 cooperates with a control cam 24 which is mounted upon a shaft 27 driven in synchronism with the main shaft of the loom. A coil compression spring 26 constantly urges the two-arm shaft counterclockwise (FIG. 3) so that the roller 27 remains in contact with the periphery of the control cam 24. The shape of the control cam 24 is chosen in dependence upon the course of the weaving cycle being performed by the loom.

Affixed to the shaft 27′ there is a toothed wheel or timing belt sprocket 270 over which there is entrained a Timing belt 151. Belt 151 is driven from the main shaft of the loom so as to rotate the shaft 27′ at constant speed.

Upon withdrawing weft thread 30 from the rotary measuring tool or device toward the weft inserting means, in this instance the jet nozzle 4, the weft thread passes through a stationary guide 25 mounted coaxially of the shaft 10. It will be understood that during the operation of the measuring device the portion 31 of the weft thread between the delivery guide 3 and the stationary guide 25 forms a bulging rotating shape usually called a balloon.

The rotary measuring tool or device of the invention operates as follows:

Control cam 24 rotates in accordance with the speed of the loom, and drives the gear segment 23 through the intermediary of the cam follower rollers 27. Thus gear segment 23 performs a swinging motion in synchronism with the operation of the loom, and transmits its motion through the intermediary pinion 11 to arm 13 and guide 3, the shaft 10 and thus the arm 13 and guide 3 rotating in opposite directions as the arm 51 and the gear segment 23 oscillate during each revolution of the shaft 27. The disc 18 is driven at a constant speed from the main shaft of the loom via belt 150 and sprocket 15, disc 18 rotating at a constant speed which is four times the speed of the main shaft of the loom. The eccentric pins 20 which form the reel 60 are mounted on the disc 18 and thus rotate therewith. As above explained, the eccentricity of the pins 20 can be changed upon releasing the screw 17 and moving the disc 18 and part 14 with respect to each other. In this manner, the effective circumference of the reel 60 can be changed, as well as the length of weft thread 30 which is wound thereon during each revolution of the shaft 10. Before starting the loom there are at lest three windings of weft thread 30 on the cranks or pins 20. Upon starting the loom, the guide 3 moves correspondingly with and in the same direction as the disc 18, and the winding of the weft thread upon the reel 60 continues until weft insertion is started. At the moment, the guide 3 begins to retard and then to rotate in the opposite direction, thus releasing a part of the formed helical winding 2. The weft insertion lasts through 90°, i.e. the last quarter of the revolution of the main shaft of the loom in this interval the guide 3 rotates three times and the disc 18 rotates once, and thus releases weft thread 30 by its opposite rotation in the last quarter of the revolution of the main shaft of the loom.

In view of the fact that the angular velocity of guide 3 can be changed by changing the contour of the cam 24, it is also possible to change the weft acceleration at the beginning of the inserting operation, its retardation at the end of the inserting operation, and to provide a possible redraft of the weft into the weft inserting nozzle 4 upon the finishing of the weft insertion operation.

It is to be understood that the device as shown in FIGS. 2 and 3 is only one of a plurality of possible variations. It is obvious that guide 3 can be shaped in any possible way, or possibly be replaced by a tube which connects guide 3 and stationary guide 25, so that the whole loop of the portion 31 of the weft thread is covered. It is also possible to control the motion of the guide or to replace the guide by a traveler which is magnetically controlled to rotate about the circumference of disc 18, etc.

Although the invention is illustrated and described with reference to one preferred embodiment thereof, it is to be expressly understood that it is in no way limited to the disclosure of such preferred embodiment but is capable of numerous modifications within the scope of the appended claims.

I claim:

1. Method of controlling weft threads in a weft thread measuring operation in a shuttleless loom which forms a shed, comprising continuously winding weft thread in one direction into a helix, continuously rotating said helix in the same direction as the direction of the winding, periodically discharging into the shed of the loom a measured length of weft thread in dependence upon the weaving process of the loom, and alternately imparting to the portion of the weft thread extending between the helix and the shed of the loom reverse rotary motions in the same and then in the opposite direction rlative to the direction of rotation of the helix, whereby the end portion of the weft thread downstream of the helix thereof is alternately wound and then unwound before its insertion into the shed of the loom.

2. A measuring tool for controlling weft thread wound into a helix in the weft thread measuring operation in a shuttleless loom which forms a shed, comprising means for continuously winding weft thread in the one direction into a helix continuously rotating said helix of weft thread in the same direction as the direction of the winding means for periodically discharging measured lengths of weft threads from the helix thereof into the shed of said loom, means for alternately imparting to the portion of the weft thread downstream of the helix thereof a rotary motion in the same and then in the opposite direction relative to the direction of rotation of the helix thereof, and means for periodically discharging in dependence upon the weaving process said portion of the weft thread for insertion in the shed of the loom.

3. A rotating measuring tool according to claim 2, comprising a reel upon which said helix of weft thread is formed, and wherein the delivery guide and the reel are mounted for radial adjustment relative to each other.

4. A rotating measuring tool according to claim 2, comprising a delivery guide mounted for rotation coaxial of the helix of weft thread, and means kinematically connecting the delivery guide with a control cam which is driven in sequentism with the main shaft of the loom.

5. A rotating measuring tool according to claim 4, wherein the delivery guide is mounted on a lever which is radially adjustably mounted on a shaft, the means for forming the helix of weft thread comprising a reel, and the reel is mounted for rotation about an axis coaxial of the shaft.

6. A rotating measuring tool according to claim 5, comprising a control cam driven in synchronism with the loom, a two-arm lever having cam follower roll mounted one arm thereof, resilient means constantly urging the cam follower roll into engagement with the surface of the cam, a gear segment mounted on the end of the other arm of the two-arm lever, and a pinion on the shaft meshing with the gear segment, whereby the shaft and the delivery guide mounting thereon are rotated in opposite directions during one weft thread measuring and releasing operation of the rotating measuring tool.

* * * * *